US005191700A

United States Patent [19]

Klappert et al.

[11] Patent Number: 5,191,700

[45] Date of Patent: Mar. 9, 1993

[54] METHOD FOR MAKING PACKETS OF AMORPHOUS METAL STRIP FOR TRANSFORMER-CORE MANUFACTURE

[75] Inventors: Willi Klappert; David R. Freeman, both of Hickory, N.C.

[73] Assignee: General Electric Company, Malvern, Pa.

[21] Appl. No.: 739,341

[22] Filed: Aug. 1, 1991

Related U.S. Application Data

[63] Continuation of Ser. No. 626,213, Dec. 12, 1990, Pat. No. 5,063,654.

[51] Int. Cl.[5] ..... H01F 41/02

[52] U.S. Cl. ..... 29/609; 83/636

[58] Field of Search ..... 29/609, 605, 606, 738; 83/636

[56] References Cited

U.S. PATENT DOCUMENTS

| | | | |
|---|---|---|---|
| 2,486,220 | 10/1949 | Somerville | 175/356 |
| 3,215,966 | 11/1965 | Lord et al. | 336/211 |
| 3,220,291 | 11/1965 | Olsen et al. | 83/236 |
| 4,413,406 | 11/1983 | Bennett et al. | 29/609 |
| 4,734,975 | 4/1988 | Ballard et al. | 29/606 |
| 4,942,798 | 7/1990 | Taub et al. | 83/636 |
| 5,093,981 | 3/1992 | Ballard et al. | 29/609 |

FOREIGN PATENT DOCUMENTS

| | | |
|---|---|---|
| 04461829 | 12/1991 | European Pat. Off. . |
| 1366176 | 6/1964 | France . |
| 416817 | 1/1967 | Switzerland . |

*Primary Examiner*—Carl E. Hall

*Attorney, Agent, or Firm*—Henry J. Policinski; William Freedman

[57] ABSTRACT

Certain transformer cores are manufactured by wrapping about an arbor packets of amorphous metal strip, each packet comprising a plurality of groups of strip, and each group comprising many thin layers of strip. This method of making such packets comprises: (a) providing composite strip comprising many thin layers of amorphous metal strip stacked in superposed relationship, (b) cutting said composite strip a first time to form a first multi-layer section of predetermined length, (c) cutting said composite strip a second time to form a second multi-layer section of predetermined length, (d) substantially aligning the first and second multi-layer sections to form from these sections one of said groups, and (e) carrying out the above cutting steps with blades capable of cutting only a predetermined maximum number of the above layers without causing the life of the blades to sharply drop, this maximum number being less than the number of layers in each group but greater than the number of layers cut in each of steps (b) and (c).

8 Claims, 3 Drawing Sheets

METHOD FOR MAKING PACKETS OF AMORPHOUS METAL STRIP FOR TRANSFORMER-CORE MANUFACTURE

CROSS-REFERENCE TO RELATED APPLICATIONS

This application is a continuation of our application Ser. No. 626,213, filed Dec. 12, 1990, now U.S. Pat. No. 5,063,654.

This invention is related to the inventions described and claimed in application Ser. No. 463,697 - Klappert et al., filed Jan. 11, 1990, now U.S. Pat. No. 5,093,981, and assigned to the assignee of the present invention, which application is incorporated by reference in the present application.

TECHNICAL FIELD

This invention relates to a method of making packets of amorphous metal strip that are adapted to be wrapped about the arbor of a transformer-core-making machine.

BACKGROUND

In the aforesaid copending application Ser. No. 463,697-Klappert et al, there is disclosed and claimed a method of making amorphous metal cores for transformers that involves making up packets of amorphous metal strip and then wrapping these packets about an arbor to build up a core form. When the core form is removed from the arbor, it has a window where the arbor was located, and the packets surround this window. Each packet comprises a plurality of groups of amorphous metal strip, and each group comprises many thin layers of strip.

In the aforesaid application Ser. No. 463,697, the groups from which the packets are assembled are derived from a composite strip comprising many thin layers of amorphous metal strip typically about 1 mil in thickness, stacked in superposed relationship. The composite strip is out into sections, and these sections are stacked one upon the other to form a packet.

The method disclosed in the aforesaid application Ser. No. 463,697 for stacking the groups to form the packets is relatively slow because each section of strip within a group, after being cut to the proper length, is first advanced to a predetermined position and is then transported laterally to a stacking position on a carrier. Laterally transporting the sections or groups to their stacking positions is a time-consuming operation and, moreover, requires relatively complicated apparatus for its implementation.

OBJECTS

An object of our invention is to provide, for making packets of amorphous metal strip which are adapted to be wrapped about the arbor of a transformer-core-making machine, a method that can be practiced relatively quickly and with relatively simple apparatus.

Another object is to provide such a method of making packets that requires no lateral movement of the groups, or the components of the groups, after they are cut from a composite strip and before they are stacked into a packet.

In one form of our invention, the groups of amorphous metal strip from which the packets are made are derived by cutting the above-described composite strip into sections using shear blades for such cutting. The life of the shear blades drops sharply if the number of amorphous metal strips, or layers, cut in any single shear-cutting operation exceeds a predetermined value.

Another object of our invention is to provide groups of amorphous metal strip, each group comprising a greater number of strips, or layers, than said predetermined number and, more specifically, to derive said groups by a shear-cutting action that does not subject the shear blades to excessive wear, i.e., the type of wear that sharply reduces their life.

SUMMARY

In carrying out our invention in one form, we provide a method of making packets of amorphous metal strip adapted to be wrapped about the arbor of a transformer-core-making machine in which: (i) each packet comprises a plurality of groups of strip, (ii) each group comprises many thin layers of strip, and (iii) each layer has two transversely-extending edges at opposite ends of the layer, the transversely-extending edges in each group being substantially aligned. This method includes the following steps: (a) providing composite strip comprising many thin layers of amorphous metal strip stacked in superposed relationship, (b) cutting the composite strip a first time to form a first multi-layer section of predetermined length, (c) cutting the composite strip a second tim to form a second multi-layer section of predetermined length, and (d) substantially aligning said multi-layer sections to form from said substantially aligned multi-layer sections one of said groups.

The cutting steps of (b) and (c) above are carried out with blades capable of cutting only a predetermined maximum number of said layers of amorphous metal strip in a single operation without causing the life of the blades to sharply drop. This maximum number is less than the number of layers in each group but is greater than the number of layers cut in each of steps (b) and (c).

BRIEF DESCRIPTION OF DRAWINGS

For a better understanding of the invention, reference may e had to the following detailed description taken in connection with the accompanying drawings, wherein.

DETAILED DESCRIPTION OF EMBODIMENT THE PACKET OF FIGS. 6 AND 7

Figure 6:
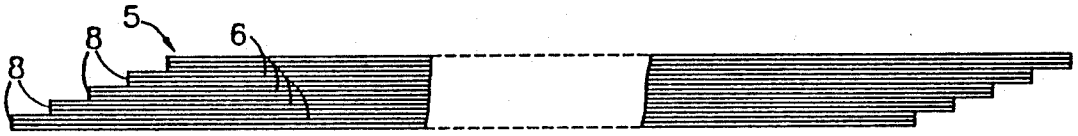
FIG. 6 is a side view of a packet of amorphous steel strip that is made by the method of our invention.
Figure 7:
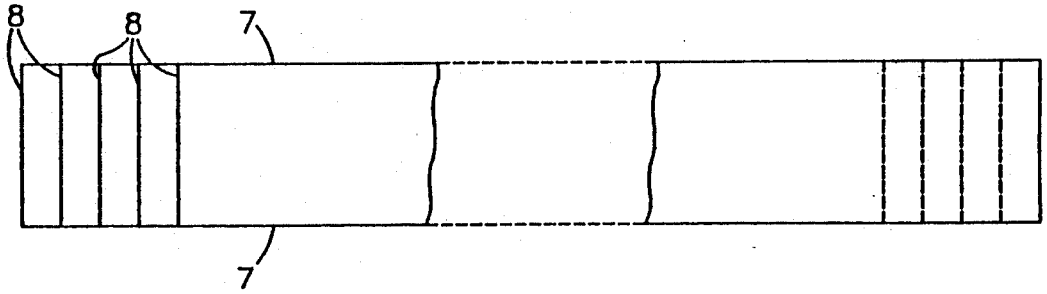
FIG. 7 is a top plan view of the packet of FIG. 6.

Referring first to FIGS. 6 and 7, there is shown a packet 5 of amorphous steel strip which is manufactured by the method of our invention. This packet comprises a plurality of groups 6 of amorphous steel strip, each group comprising many thin layers of elongated strip. In each group, the layers of strip have longitudinally-extending edges 7 at opposite sides thereof and transversely-extending edges 8 at opposite ends thereof. In each group the longitudinally-extending edges 7 of the strips at each side of the group are aligned, and the transversely-extending edges 8 of the strips at each end of the group are aligned.

In the packet of FIGS. 6 and 7, the groups 6 are made progressively longer beginning at the bottom (or inside) of the packet and proceeding toward the top (or outside) of the packet. This increased length enables the groups to completely encircle the increasingly greater circumference of the core form as the core form is built up when the packets are wrapped about an arbor, as is shown, for example, in the aforesaid Klappert et al application Ser. No. 463,697. The packets are wrapped about the arbor with their inside, or shortest, group nearest the arbor.

Referring still to FIGS. 6 and 7, adjacent groups in each packet have their transversely-extending ends staggered so that at one end of the packet the adjacent groups underlap, and at the other end of the packet the adjacent groups overlap. This staggering results in distributed type joints in the final core after the above-described wrapping about an arbor.

Positioning and Then Cutting the Composite Strip 12 to Detach a First Section 54

Figure 1:
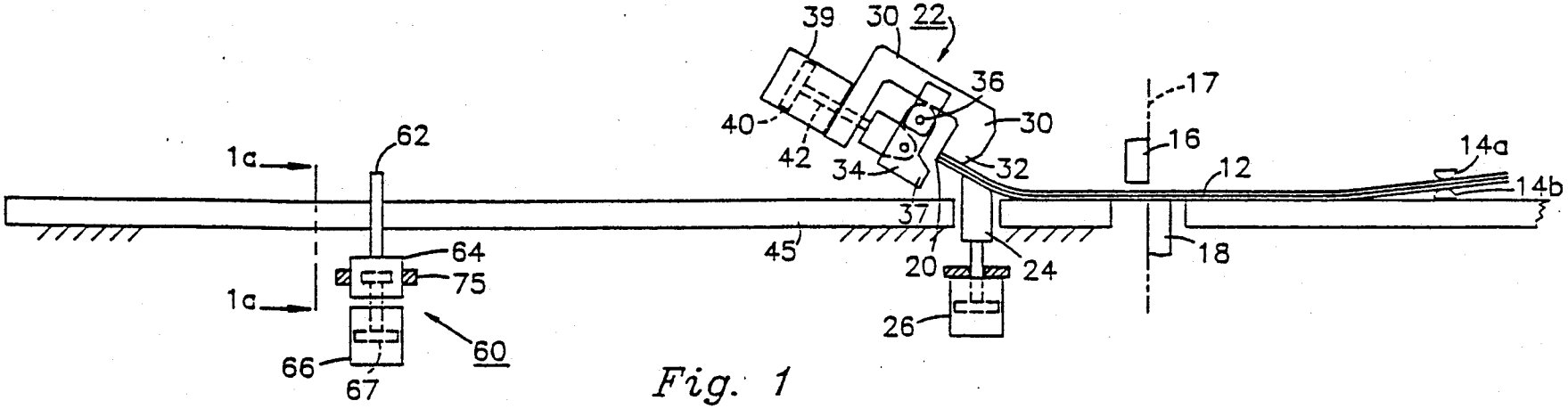
FIG. 1 is a schematic side elevational view of apparatus used in practicing one form of our invention. In this figure the apparatus is depicted in a state where the leading edge of the parent composite strip has been advanced beyond the shear blades, but before the composite strip has been advanced to a position where the first section of strip is cut therefrom by the shear blades.

Referring now to FIG. 1 the composite amorphous metal strip from which the above-described groups and packets are derived is shown at 12. This strip 12 is advanced into its position of FIG. 1 by feeding means schematically shown at 14, which has a normal position to the right of that depicted in FIG. 1. When the feeding means is in its normal position, it grips the composite strip between jaws 14*a*, 14*b* and then moves to the left, advancing the composite strip into its position of FIG. 1.

In its position of FIG. 1, the composite strip 12 is positioned between two shear blades 16 and 18, which are relatively movable in a vertical direction to cut the composite strip by a shearing operation. A preferred form of these shear blades is shown and claimed in U.S. Pat. No. 4,942, 798-Taub et al which is incorporated by reference in the present application. The cutting location is along the plane 17 of FIG. 1.

The leading edge 20 of the composite strip 12 is shown in FIG. 1 in a position where it can be grasped by a car clamp 22, which after such grasping moves to the left to further advance the composite strip, as will soon be described in more detail. The leading edge 20 is raised into a position where it can be easily grasped by the car clamp by means of a raise bar 24. This raise bar 24, which is operated by an air cylinder 26, is lifted by the air cylinder when the leading edge 20 is near its position of FIG 1. After the car clamp 22 has grasped the leading portion of the composite strip 12, the air cylinder 26 lowers the raise bar 24 to a non-interfering position with respect to the composite strip.

The car clamp 22 comprises a C-frame 30 forming a first jaw 32 at one end of the C-frame and an arm 34 pivotally mounted at 36 and forming another jaw 37 at one end of the arm. An air cylinder 39 is carried by the C-frame and comprises a movable piston 40 and a piston rod 42 coupled to the piston and pivotally connected at its lower end to the arm 34. When the piston 40 is operated in a downward direction, it pivots the arm 34 counterclockwise about pivot 36, causing jaw 37 to approach jaw 32, thereby gripping the leading end of the composite strip between the jaws.

Figure 2:
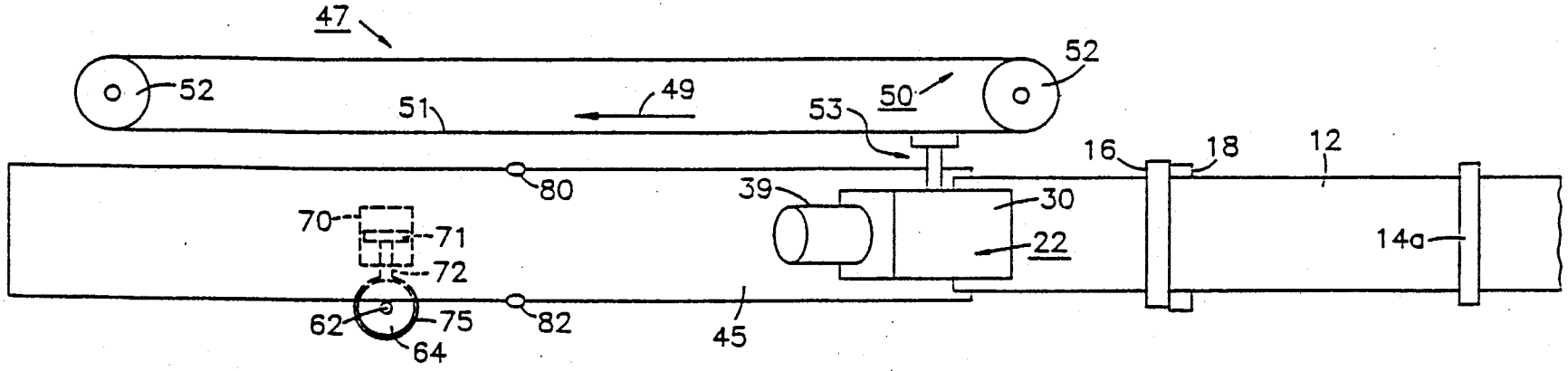
FIG. 2 is a top plan view of the apparatus of FIG. 1.

The car clamp 22 is positioned a small distance above a supporting table 45 and is movable along the length of the table by indexing means 47 schematically shown in FIG. 2. This indexing means 47, in the illustrated embodiment, comprises a chain and sprocket drive 50 that is capable of advancing its chain 51 (as indicated by arrow 49) along the desired path of movement of the composite strip. The car clamp 22 is mechanically coupled to the chain 51, as shown schematically at 53, so that when the chain is driven by its sprockets 52 in the direction of arrow 49, the car clamp, then grasping the leading portion of the composite strip, advances the composite strip into the position depicted in FIG. 3. During such advancing motion, the jaws 14*a* and 14*b* of the upstream feeding means are separated and do not grip the composite strip.

Figure 3:
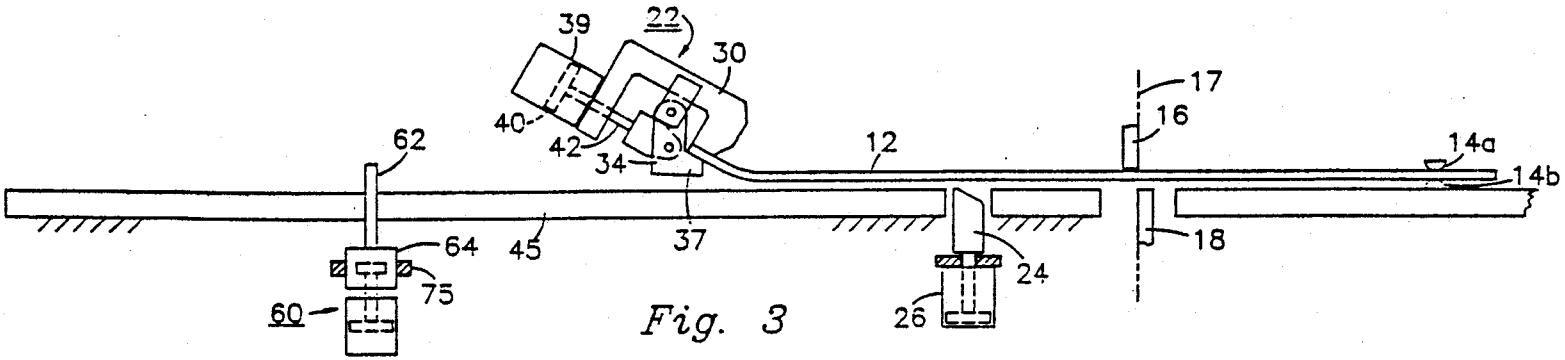
FIG. 3 is another side-elevational view of the apparatus depicted in FIG. 1. In this figure the parent composite strip has been advanced to a position where it is ready to be cut by the shear blades to detach a section thereof.

When the leading end of the composite strip 12 arrives in its position of FIG. 3, the jaws of the upstream feeding means 14 are operated toward each other to again grip the composite strip so that the strip is held taut between the car clamp 22 and the upstream feeding means, following which a shear-cutting operation is effected by the blades 16 and 18. This cutting operation detaches the leading portion of the composite strip 12 from the remainder of the composite strip, thereby producing a detached section 54 and forming a new leading edge at the cutting location 17 on the remainder of the composite strip.

Advancing the First Detached Section 54 to a Stacking Position on Table 45

Figure 4:
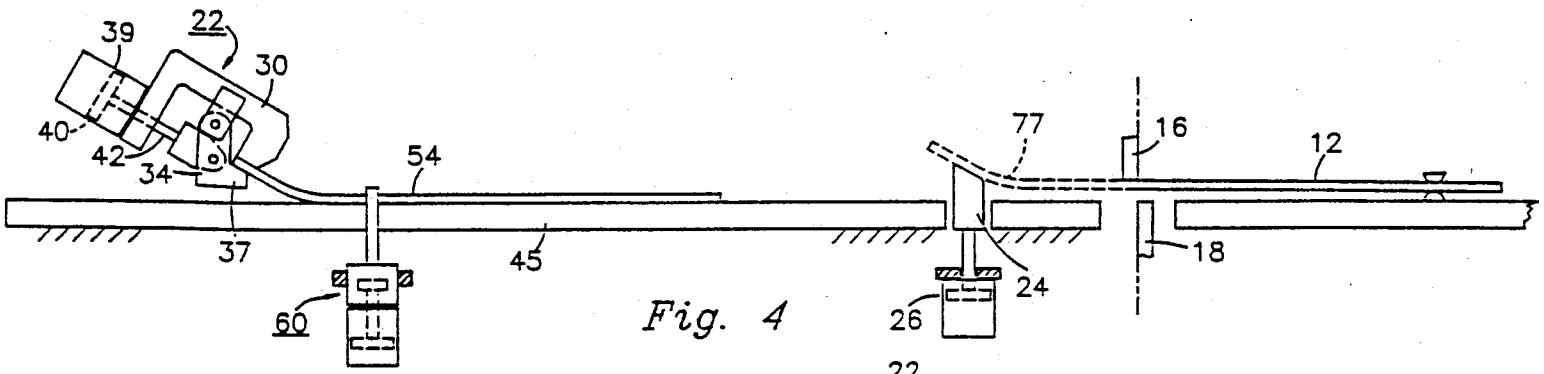
FIG. 4 is still another side-elevational view of the apparatus depicted in FIG. 1. In this figure a first section of the composite strip, detached from the parent strip by a shear-cutting operation, has been advanced to a stacking position.

When the above shear-cutting operation has been completed, the car clamp 22, which is then grasping the leading end of the detached section 54, is advanced forward to its position of FIG. 4, carrying the detached section in an axial, or longitudinal, direction into its stacking position of FIG. 4. This advancing motion of the car clamp 22 is effected by the indexing means 47 driving chain 51 further along the table 45. When the detached section 54 enters advanced its position of FIG. 4, it is clamped to the supporting table 45 by clamping means 60, soon to be described. When the clamping means 60 has thus clamped section 54 to table 45, the car clamp 22 releases the section 54 and is returned to its home position of FIG. 1 by the indexing means 47. Such return motion of the indexing means 47 is carried out by driving the indexing chain 51 in a reverse direction (opposite to arrow 49).

Clamping Means 60

Figure 1A:
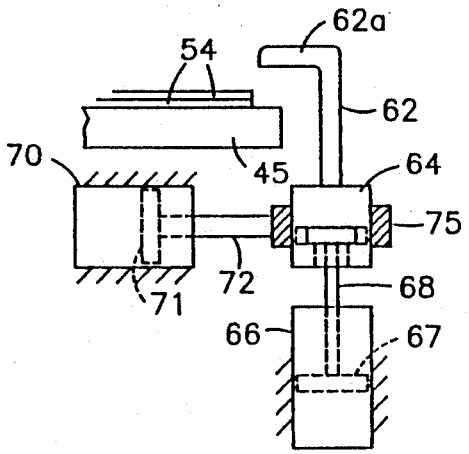
FIG. 1*a* is a sectional view taken along the line 1*a*—1*a* of FIG. 1.

The above-referred-to clamping means 60, in its illustrated form best shown in FIG. 1*a*, comprises an L-shaped clamping member 62 attached to a carriage 64 that is movable in two planes. Up and down movement of the carriage 64 is effected by a first air cylinder 66 having a piston 67 and a piston rod 68 coupled to the carriage 64 through a connection that allows lateral movement of the carriage with respect to the piston rod. Side-to-side movement of the carriage 64 is effected by a second air cylinder 70 having a piston 71, a piston rod 72, and an annular coupling member 75 slidably receiving the carriage in such a manner that the carriage can move vertically with respect to the annular coupling member but is tied to the coupling member for horizontal motion.

When the L-shaped clamping member 62 is to be used for clamping one or more sections of amorphous strip to the supporting table 45, the L-shaped member is lifted to its position of FIG. 1*a* by air cylinder 66, the section (or sections) 54 are placed on the table 45, the carriage 64 is driven to the left by air cylinder 70 to position the upper leg 62*a* of the L-shaped member over the lateral edge of section(s) 54, and the air cylinder 66 is then operated to drive the L-shaped member 62 downward so that its upper leg 62*a* engages the top of section(s) 54, thus clamping section(s) 54 to the table 45.

Advancing the Composite Strip 12 While the Car Clamp 22 Is Stacking a Detached Section and Is Being Reset Prior to the return of the car clamp 22 to its position of FIG. 1, the new leading edge of the remaining composite strip 12 is advanced into its dotted line position 77 shown in FIG. 4. Accordingly, when the car clamp 22 returns to its FIG. 1 position, the new leading portion of the composite strip 12 is ready to again be grasped by the car clamp. The car clamp accordingly grasps this new leading portion, moves to the left into a position similar to that of FIG. 3, thus advancing the composite strip into a position where it is again cut by the blades 16, 18 to detach another section 54 from the composite strip. This detached section 54 is then axially advanced by leftward motion of the car clamp 22 to a position similar to that of FIG. 4. Such axial advancing motion carries the second section along the length of the first, then-clamped, section. When the second section enters its final, or stacking, position, the clamp 60 is temporarily released from the first section and is immediately thereafter applied to the edge of the second section, thus clamping the second section to the supporting table 45 atop the first section.

Stacking the Sections 54 To Form Groups and Packets

In our apparatus, we form each group by cutting two consecutive sections 54 of equal length from the composite strip and stacking the second of these sections atop the first section so that the two sections are substantially aligned. That is, the transversely-extending edges 8 (FIG. 7) at each end of the two sections are substantially aligned, and the longitudinally-extending edges 7 at each side of the two sections are substantially aligned.

After the second section has been stacked atop the first section to form a first group as above described, a third section is cut from the composite strip 12 and stacked atop the second section in a similar manner as the second section was cut and stacked. The third section, however, is made longer than the first two sections by an amount $2\pi T$, where T is the thickness of the first group. In addition, the third section is placed upon the second section in such a position (shown in FIGS. 5–7) that its leading edge is offset, or staggered, from the leading edge of the second section by an underlap amount of 0.25 to 1.0 inch. A fourth section of the same length as the third section is then cut and stacked atop the third section in alignment therewith, thus completing a second group atop the first group.

Figure 5:
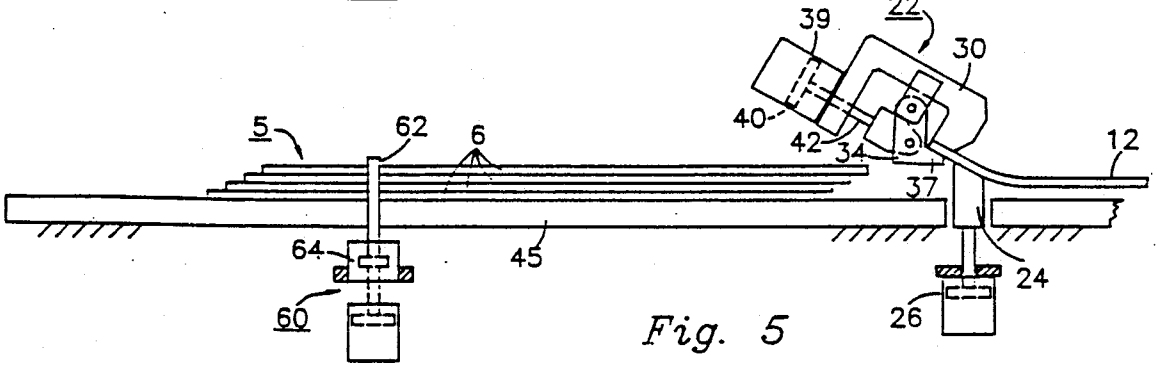
FIG. 5 is still another side-elevational view of the apparatus of FIG. 1. In this figure several groups have been stacked to form a portion of a packet, and the apparatus is in readiness to advance the parent composite strip so that another section of the parent composite strip may be detached therefrom and stacked upon the already-stacked groups.

Additional groups are made up in the same manner, each being stacked atop the immediately-preceding group and being clamped to the immediately-preceding group and the supporting table 45 immediately after such stacking. Each succeeding group is made longer than the immediately-preceding group by an amount $2\pi T$, and the leading edge of each group is offset from the leading edge of the immediately-preceding group by an amount of 0.25 to 1.0 inch. FIG. 5 shows four groups 6 stacked and clamped in this manner upon the supporting table 45, with the car clamp 22 in readiness to again advance the composite strip in preparation for forming the first section of a fifth group to be stacked atop the already-assembled four groups.

To facilitate locating each newly detached section upon the already deposited sections with their longitudinally-extending edges at each side in alignment, a pair of vertically-extending guide pins 80 and 82 (FIG. 2) are positioned at opposite edges of the supporting table. These pins 80 and 82 guide the lateral edges of each newly-detached section as it is being laid down upon those already deposited, thus maintaining the edges at each side in substantial alignment.

Forming Each Group (6) from a Plurality of Sections (54)

As pointed out hereinabove, each group is made by cutting two sections (54) from the composite strip 12 and stacking the second section atop the first one in aligned relationship therewith. The reason for using two separate cutting operations for making a single group is that amorphous steel is extremely hard, and the shear-cutting blades 16, 18 can be used for cutting only a predetermined maximum number of amorphous steel strips, or layers in a single operation without causing the life of the blades to sharply drop. This maximum number is less than the number of strips, or layers that we include in each group. For example, the maximum number is typically 15 to 20, and we include 30 strips in each group. Accordingly, by cutting the 30 strips in two separate shearing operations, we limit the number of strips cut in a single operation to less than the predetermined maximum that produces excessive blade-wear, i.e., blade-wear that sharply reduces the life of the blades.

Factors Contributing to High Speed of Operation

There are a number of factors which contribute to the high speed with which our method can produce an amorphous metal packet suitable for wrapping around the arbor of a transformer-core-making machine. One of these is that it is not necessary to laterally transport each section or group to another location for assembling the packet, as is the case in the apparatus of the aforesaid application Ser. No. 463,697. Our packets are assembled in essentially the same location as where the sections or groups are formed. Or stated another way, the detached sections are positioned during stacking in stacking locations that (as viewed in FIG. 2) are in alignment with the composite strip 12 when the composite strip is positioned for cutting. While our sections do need to be advanced after a cutting operation into appropriate positions for effecting the desired aligned or staggered relationships of the sections within a packet, such advancing is not an extra step since it has also been necessary in the method of application Ser. No. 463,697 to include this advancing step.

Another factor that contributes to a reduction in the time required to make a packet is that, as the sections of the packet are stacked, the packet builds in a direction toward the shear blades (16, 18). Thus, the car clamp 22 is called upon to travel a progressively shorter distance, both forward and reverse, in order to deposit each section of the packet as the packet builds up. Reducing this distance reduces the time required to deposit each packet and to reset the car clamp to its home position, and this shortens the total time for making a packet.

Still another factor that contributes to reducing the time required for making a packet is that while the car clamp 22 is moving through its above-described forward travel to deposit a section of strip and then through its return travel to reset, the upstream feeding means 14 can be operated through its normal cycle. More specifically, the upstream feeding means 14 is able during this interval to release the composite strip, to return to the right to its normal position, and then grip the composite strip and advance it into its position of FIG. 1, where the leading edge 20 can again be grasped by the car clamp 22 when the car clamp is returned to its home position. A suitable interlock (not shown) assures that the composite strip is correctly positioned as shown in FIG. 1 before the jaws of the car clamp 22 are operated to attempt grasping of the leading edge.

General

It is to be understood that the above-described packet-making operations are repeated over and over again to form many packets. After each packet is formed as above described, it is unclamped from the supporting table 45, lifted off the table, and then wrapped about the arbor of the core-making machine. Core-making machines suitable for such use are shown and claimed in the aforesaid application Ser. No. 463,697 and in another application assigned to the assignee of the present invention, Ser. No. 535,538-Klappert and Houser, filed Jun. 11, 1990, now abandoned, but replaced by continuation application Ser. No. 623,265, filed Dec. 6, 1990. After each packet is wrapped about the arbor, the joint formed at the mating ends of each packet can be examined either visually or by suitable sensing means and if the mating ends are not optimally positioned with respect to each other, the lengths of the sections making up the next packet can be appropriately adjusted to compensate for such variations.

As pointed out herein, each group is normally made longer than its immediately-preceding group by an amount $2\pi T$, and this enables each group to encircle the arbor to the desired extent as the core form builds up. If the joints being formed are lap joints, the amount of overlap is monitored as the packets are wrapped about the arbor to build up the core form, and the length of the groups in subsequently-formed packets is adjusted to maintain this overlap within desired limits.

It is to be understood that our invention in its broader aspects comprehends the making of packets for a butt-joint type core as well for a lap-joint type core.

While we have shown and described a particular embodiment of our invention, it will be obvious to those skilled in the art that various changes and modifications may be made without departing from our invention in its broader aspects; and we, therefore, intend herein to cover all such changes and modifications as fall within the true spirit and scope of our invention.

What we claim as new and desire to secure by Letters Patent of the United States is:

1. A method of making packets of amorphous metal strip adapted to be wrapped about the arbor of a transformer-core-making machine, each packet comprising a plurality of groups of strip, each group comprising many thin layers of strip, each layer having two longitudinally-extending edges at opposite sides of the layer and two-transversely extending edges at opposite ends of the layer, the longitudinally-extending edges at each side of the layers of each group being substantially aligned and the transversely-extending edges at each end of the layers in each group being substantially aligned, said method comprising:

(a) providing composite strip comprising many thin layers of amorphous metal strip stacked in superposed relationship, (b) cutting said composite strip a first time to form a first multi-layer section of predetermined length, (c) cutting said composite strip a second time to form a second multi-layer section of predetermined length, (d) substantially aligning said multi-layer sections to form from said substantially aligned multi-layer sections one of said groups, and (e) carrying out the cutting steps of (b) and (c) hereinabove with blades capable of cutting only a predetermined maximum number of said layers of amorphous metal strip without causing the life of the blades to sharply drop, sad maximum number being less than the number of layers in each group but greater than the number of layers cut in each of steps (b) and (c).

2. A method as defined in claim 1 in which said aligning of said multi-layer sections is effected by moving one of said sections into a position such that said one section substantially aligns with the other of said multi-layer sections.

3. A method as defined in claim 1 in which the cutting steps of paragraphs (b) and (c) are preformed on a single composite strip at locations longitudinally spaced along the length of said strip.

4. A method as defined in claim 1 in which a plurality of groups are made as specified in claim 1 and in which said plurality of groups are stacked together in positions that locate the adjacent trasversely-extending edges of adjacent groups in staggered relationship with respect to each other.

5. A method as defined in claim 1 in which said predetermined maximum number is between 15 and 20.

6. A method as defined in claim 1 in which: (a) said predetermined maximum number is between 15 and 20, and (b) the number of layers cut in each of steps (b) and (c), claim 1, is about 15.

7. A method as defined in claim 5 in which each of said layers of strip is about 1 mil in thickness.

8. A method as defined in claim 6 in which each of said layers of strip is about 1 mil in thickness.

* * * * *

UNITED STATES PATENT AND TRADEMARK OFFICE

CERTIFICATE OF CORRECTION

PATENT NO. : 5,191,700

DATED : March 9, 1993

INVENTOR(S) : W. Klappert and D.R. Freeman

It is certified that error appears in the above-identified patent and that said Letters Patent is hereby corrected as shown below:

Column 1, in the line numbered 39, after "strip" insert a comma (,)
Column 3, in the line numbered 58, after "et al" insert a comma (,)
Column 4, in the line numbered 56, delete "advanced its" and substitute - its advanced -
Column 8, in the line numbered 37, change "sad" to - said -
Column 8, in the line numbered 47, change "preformed" to - performed -

Signed and Sealed this

Twenty-third Day of November, 1993

*Attest:*

*Attesting Officer*

Bruce Lehman

BRUCE LEHMAN

*Commissioner of Patents and Trademarks*